United States Patent [19]

Tatsuta et al.

[11] 4,116,696

[45] Sep. 26, 1978

[54] PHOTOGRAPHIC MATERIAL

[75] Inventors: Sumitaka Tatsuta; Masuhiko Hirose; Hiroshi Amari, all of Fujimiya, Japan

[73] Assignee: Fuji Photo Film Co., Ltd., Minami-ashigara, Japan

[21] Appl. No.: 748,030

[22] Filed: Dec. 6, 1976

Related U.S. Application Data

[63] Continuation-in-part of Ser. No. 547,682, Feb. 6, 1975, abandoned.

[30] Foreign Application Priority Data

| | | | |
|---|---|---|---|
| Feb. 6, 1974 | [JP] | Japan | 49-15107 |
| Feb. 5, 1975 | [GB] | United Kingdom | 4972/75 |
| Feb. 6, 1975 | [DE] | Fed. Rep. of Germany | 2505017 |

[51] Int. Cl.[2] ..... G03C 1/80

[52] U.S. Cl. ..... 96/87 R; 106/131; 106/136; 252/312

[58] Field of Search ..... 96/87 R; 252/312; 106/131, 136

[56] References Cited

U.S. PATENT DOCUMENTS

| | | | |
|---|---|---|---|
| 2,943,936 | 7/1960 | Spechler | 96/87 R |
| 3,042,524 | 7/1962 | Albus et al. | 106/136 |
| 3,704,162 | 11/1972 | Oshibushi et al. | 96/87 R |
| 3,933,516 | 1/1976 | Mackey | 106/131 |

*Primary Examiner*—John D. Welsh

*Attorney, Agent, or Firm*—Sughrue, Rothwell, Mion, Zinn and Macpeak

[57] ABSTRACT

A photographic material comprising a support having thereon at least one photographic layer with the layer adjacent the support containing non-volatile or low volatile liquid droplets having smaller diameters than the thickness of the layer adjacent the support and a process for producing the photographic material.

11 Claims, No Drawings

PHOTOGRAPHIC MATERIAL

This application is a continuation-in-part of Ser. No. 547,682, filed Feb. 6, 1975 now abandoned.

BACKGROUND OF THE INVENTION

1. Field of the Invention

This invention relates to a photographic material and, in particular, to a photographic material comprising a photographic layer of a hydrophilic colloid provided on a support having a hydrophobic surface.

2. Description of the Prior Art

Polyethylene terephthalate, cellulose triacetate, polystyrene, polyolefin laminated paper, etc. have generally been used so far for conventional photographic supports because of their excellent transparency and/or flexibility. Unfortunately, all of these materials have highly hydrophobic surfaces, so that it is very difficult to adhere a photographic layer of a hydrophilic colloid, generally of gelatin, tightly on the supports.

Prior art processes, which are employed to overcome the above-described difficulty, for obtaining an effective adhesive strength between a photographic emulsion layer and the surface of the support by way of the surface treatment, particularly, a treatment for rendering the hydrophobic surface of the support hydrophilic comprise the following two types of processes:

(1) Applying a surface activation treatment such as a chemical treatment, a mechanical treatment, a corona discharge, a flame treatment, a UV irradiation, a radio-frequency treatment, a glow discharge, an active-plasma treatment, a laser treatment, a mixed acid treatment or ozone-oxidation followed by the direct coating of a photographic emulsion to provide adhesion.

(2) Providing a subbing layer after the above surface treatments and coating a photographic emulsion layer thereon (for example, as disclosed in U.S. Pat. Nos. 2,698,241, 2,764,520, 2,864,755, 2,864,756, 2,972,534, 3,057,792, 3,071,466, 3,072,483, 3,143,421, 3,145,105, 3,145,242, 3,360,448, 3,376,208, 3,462,335 and 3,475,193, and British Patent Nos. 788,365, 804,005 and 891,469).

The latter method (2) is more effective and, hence, widely used.

It is believed that in all of these surface treatments, the surface of the support is rendered hydrophilic due to the formation of polar groups, more or less, on the surface of the support which is hydrophobic in nature, etc. and, as the result, the affinity of the surface for the polar groups of the components contained in the subbing composition is increased.

Various techniques have been employed for coating a subbing layer and they include the so-called double-layer method in which a first layer exhibiting excellent adhesion to the support is provided and then a second layer of a hydrophilic resin is coated thereon, and a single layer method in which only one resin layer containing both hydrophobic groups and hydrophilic groups is coated.

All of these methods have been studied thoroughly and various resins have been examined for their suitability for use as a subbing layer, including, for example, copolymers of vinyl chloride, vinylidene chloride, methacrylic acid, acrylic acid, itaconic acid, maleic anhydride, etc., as well as polyethyleneimine, epoxy resins, grafted gelatin-nitrocellulose and the like. These methods, however, inevitably have the following defects:

(A) Insufficient adhesive strength

In particular, with a support of polyethylene terephthalate, polystyrene, etc., the adhesive strength obtained with only a surface activation described in (1) above can not satisfy at all the practical requirements for photographic materials. Moreover, in coating a subbing composition, a resin having a good affinity for and excellent adhesion to the hydrophobic support generally exhibits poor affinity for and only insufficient adhesion to a hydrophilic photographic layer to be coated thereon. On the contrary, a hydrophilic resin having a good affinity for the photographic layer, when used as a subbing layer, exhibits excellent adhesion to the photographic layer but insufficient adhesion to the support.

(B) Subbing coating requires many steps and much time

Since gelatin is often used as a resin for a photographic binder, the photographic layer is coated and dried at extremely low temperatures (for example, the gelatin is cooled to a temperature below about 10° C and then dried at a temperature below about 50° C), taking advantage of the specific property of gelatin of gelling at lower temperatures. However, when the above described polymers are used as a subbing layer, these polymers should be heated, after cooling, to higher temperatures, for example, about 100° C or more for drying because they generally lack the property of gelling at lower temperatures. In addition, these synthetic high molecular weight compounds often require organic solvents as a solvent instead of water that can be used for gelatin. This necessitates an additional coating apparatus for such an organic solvent separate from that used for the photographic layers. These coating and drying steps must be repeated two or three times in a double subbing layer method.

(C) Problems of toxic gases, skin irritation, environmental pollution, etc.

For further improving the adhesive strength of the subbing layer described above, various means have been employed, for example, solvents which swell or dissolve the support or the so-called etching agents which have high polarity and a high boiling point and which are expensive have been incorporated in a large quantity into a subbing composition. For example, etching agents for polyester include compounds having an aromatic ring (such as a benzene ring, a naphthalene ring, a pyridine ring, a pyrrole ring or a condensed ring thereof, or these aromatic rings substituted with one or more of alkyl, alkoxy, acyl, nitro, cyano, hydroxy, formyl, carboxy, alkoxycarbonyl, hydroxyalkyl, aminoalkyl or haloalkyl groups, halogen atoms, or the like), alcohols, ketones, carboxylic acids, esters, aldehydes, or the like (for example, as disclosed in British Patent Nos. 772,600, 776,157, 785,789 and 797,425, U.S. Pat. No. 2,830,030, and German Patent Nos. 1,020,457 and 1,092,652). Specific examples of these etching agents are benzoic acid, salicylic acid, salicyclic acid ester, monochloroacetic acid, dichloroacetic acid, trichloroacetic acid, trifluoroacetic acid, methanesulfonic acid, trifluoromethanesulfonic acid, nitropropanol, benzyl alcohol, benzaldehyde, acetylacetone, acetylphenol, benzamide, benzonitrile, anisole, nitrobenzyl alcohol, chlorobenzyl alcohol, pyrrole, chloral hydrate, benzylamine, xylylenediamine, nicotinic acid amide and nicotinic acid ester.

Other examples of these etching agents, which are particularly well known and generally used widely, are compounds having phenolic hydroxyl groups such as phenol, o-chlorophenol, p-chlorophenol, dichlorophenol, phenylphenol, chlororesorcin, fluoroglycine, orcinol, pyrogallol, gallic acid, o-cresol, m-cresol, p-cresol, resorcin or methoxyphenol.

It is, however, well known that these etching agents are usually difficult to handle and harmful to the human body. Further, phenolic compounds often provide serious problems in operation since they have strong irritation to and penetration into the skin. Moreover, these compounds, if contained in waste water or exhaust gases, cause a destruction of the environment and should, therefore, be substantially recovered, which requires additional waste treatment facilities.

(D) Unevenness of the film surface

In the prior art processes, considerably high temperatures are required for drying the subbing layer as described above in paragraphs (B) and (C).

Particularly, since phenolic compounds generally have a high boiling point above about 180° C, the drying of the subbing layer of these compounds requires heating for a rather long time. Therefore, undesirably, expansion and reduction in the modulus of elasticity occur in polyesters during drying, particularly at the earlier stage of the drying, due to the increase in the degree of crystallinity caused by the penetration of the solvent into the polyester support, and shrinkage in polyesters occurs at the later stage of the drying, thereby resulting in a marked unevenness of the surface.

(E) Temperature control is difficult in the drying of the subbing layer

Since the etching capability of the solvent is highly temperature-dependent, the adhesive strength per se, if it is produced by an anchoring effect of the resin to the support, is also highly dependent on the temperatures used in the steps of coating, drying, etc.

This is a serious problem from the standpoint of production in a stable manner.

SUMMARY OF THE INVENTION

This invention has been developed with a view to overcome these defects found in the prior art processes.

A first object of this invention is to provide a photographic material having a strong adhesive strength between a support and a photographic layer.

A second object of this invention is to provide a photographic material suitable for simultaneous coating of a photographic layer and a subbing layer and thus for simplifying the production steps and reducing the number of production steps.

A third object of this invention is to provide a photographic material which does not cause environmental pollution. That is, drying of organic solvents is not always required to obtain a photographic material of this invention, which prevents toxic organic solvents from being discharged in exhaust gasses or waste water.

A fourth object of this invention is to provide a photographic material in which a subbing composition which is less irritative to the skin is used.

A fifth object of this invention is to provide a photographic material having a surface with excellent evenness.

A sixth object of this invention is to provide a photographic material having a range of tolerance with respect to changes in the temperatures in the steps.

These and other objects of this invention will be apparent from the following description in this specification.

This invention provides a photographic material comprising a hydrophobic support having a subbing layer comprised of a hydrophilic resin adjacent thereto and at least one hydrophilic photographic layer on said subbing layer, wherein said subbing layer contains droplets of a non-volatile or low volatile hydrophobic liquid having a boiling point above about 120° C, a solubility in water of about 10 g/100 g water, at 25° C, or less and not completely miscible with the subbing layer, said droplets having a diameter of between about 0.01 and 1 micron and less than the thickness of said subbing layer and being present in an amount of from 1/5 to 3 times by volume to the volume of the subbing layer resin on a dry basis.

Further this invention provides a method of preparing a photographic material which comprises coating on a hydrophobic support a layer of subbing composition comprised of a hydrophilic resin adjacent thereto containing droplets of non-volatile or low volatile hydrophobic liquid having a boiling point above about 120° C, a solubility in water of about 10 g/100 g water at 25° C, or less and not completely miscible with the remainder of said subbing composition, said droplets having a diameter between about 0.01 $\mu$ and 1 $\mu$ and less than the thickness of said subbing layer and being present in an amount of from 1/5 to 3 times by volume to the volume of the subbing layer resin on a dry basis, and on said subbing layer at least one hydrophilic photographic layer and drying the resulting material, wherein said droplets are present after said photographic material has been dried.

DETAILED DESCRIPTION OF THE INVENTION

In using the subbing composition according to this invention, it is not at all necessary to incorporate the etching agents described above into the subbing composition, but they can be incorporated therein, if desired.

While the use of such etching agents for the support is indispensable in using a conventional subbing composition and the adhesion is obtained due to an anchoring effect between the subbing layer and the support caused by the effect of the etching agent, sufficient adhesion can now be attained without using such etching agents in employing the subbing composition of this invention, and this is one significant effect of this invention.

Supports which can be used in this invention include any supports of hydrophobic high molecular weight substances. Particularly suitable supports for use in photography are, for example, cellulose derivatives such as cellulose acetate, cellulose acetate butyrate, cellulose acetate propionate or cellulose nitrate, styrene polymers such as polystyrene, styrene-butadiene copolymers, styrene-butadiene-acrylonitrile copolymers or poly-$\alpha$-methylstyrene, polyesters such as polyethylene terephthalate, polyhexamethylene terephthalate, polyethylene-2,6-naphthalate or polycarbonate, polyolefins such as polyethylene or polypropylene, from the standpoint of transparency, flexibility and other chemical properties. The supports can be transparent or can contain a dye or a pigment such as titanium dioxide. Moreover, the supports can include laminated films in which a plastic is laminated on a paper or plastic films whose surfaces may be treated as described in U.S. Pat. No. 3,515,567.

As resins coated on the support, those resins which have a good affinity for hydrophilic photographic layers and which generally have high polarity are often used. Therefore, the support preferably is previously subjected to a surface activation as described above. Particularly preferred processes for surface activation are corona discharge, glow discharge, electrodeless discharge, flame treatment, etc. for the sake of the convenience and the effect obtained.

The apparatus and techniques for such activation treatments are described in the above-described patent specifications and the like and used advantageously.

The photographic layer used in this invention, which includes a non-light-sensitive layer and a light-sensitive layer, is explained briefly in the following.

Examples of suitable binders for the photographic layer (hydrophilic organic protective colloids), which can be used in this invention, include synthetic or natural hydrophilic high molecular weight compounds, for example, gelatin, acylated gelatin such as phthalated gelatin or maleated gelatin, cellulose derivatives such as carboxymethyl cellulose or hydroxyethyl cellulose, grafted gelatin prepared by grafting acrylic acid, methacrylic acid or the amides thereof to gelatin, polyvinyl alcohol, polyhydroxyalkyl acrylates, polyvinyl pyrrolidone, vinyl pyrrolidonevinyl acetate copolymers, casein, agarose, albumin, sodium alginate, polysaccharides, agar agar, starch, grafted starch, polyacrylamide, acylated polyethyleneimine, or homopolymers of acrylic acid, methacrylic acid, acrylamide, methacrylamide, N-substituted acrylamide or N-substituted methacrylamide, the copolymers thereof or the partially hydrolyzed products thereof. These binders can be used individually or in admixture.

It is not particularly important in this invention what types of additives are incorporated in the binder if the hydrophilic high molecular weight compounds as described above are employed as a binder. However, to these hydrophilic binders are usually added various additives including light-sensitive substances such as silver halide, physical development nuclei, for example, silver sulfide used in the diffusion transfer process, or diazo compounds, color couplers, latex polymers obtained from emulsion polymerization, etc.

Since all of binders for the photographic layer are hydrophilic as described above, it was difficult in the prior art to adhere these binders directly on the hydrophobic supports tightly.

If desired, a compatible mixture of two or more binders described above can also be used. Of the above-described binders, gelatin is most generally used but gelatin can be, partially or completely, replaced with a synthetic high molecular weight substance, as well as a so-called gelatin derivative.

Resins used for the subbing layer are suitably the same as the resin for forming a photographic layer coated thereon in view of the good adhesive property, although a different resin can also be used. In addition, resins having a relatively hydrophilic group other than the above-described resins can also be used. Regarding subbing techniques, the adhesion between the hydrophilic resin and another hydrophilic resin can be relatively easily attained because of the strong polar bonding strength produced between them, and difficulty is found in adhering the hydrophilic resin tightly on the hydrophobic support.

An advantageous feature of the photographic material of this invention is the constitution of the subbing layer in the material and, in particular, the dispersion of the small liquid droplets incorporated in a polymer binder of the subbing layer. If a subbing layer having the constitution according to this invention is provided on a support, the adhesion between the subbing layer and the support can be remarkably increased as compared with the case of coating the same resin alone as a uniform layer, irrespective of the constituent resin of the subbing layer.

Therefore, the photographic material produced has a very strong adhesion to the support, provided that the adhesion between the resin of the hydrophilic subbing layer and the photographic layer is satisfactory. Suitable resins which have a good affinity for the photographic layer generally include, in addition to the resins described above, polymers of monomers having polar groups in the molecule such as carboxyl, carbonyl, hydroxy, sulfo, amino, amido, epoxy or acid anhydride groups, for example, acrylic acid, sodium acrylate, methacrylic acid, itaconic acid, crotonic acid, sorbic acid, itaconic anhydride, maleic anhydride, cinnamic acid, methyl vinyl ketone, hydroxyethyl acrylate, hydroxyethyl methacrylate, hydroxychloropropyl methacrylate, hydroxybutyl acrylate, vinylsulfonic acid, potassium vinylbenzenesulfonate, acrylamide, N-methylacrylamide, acryloylmorpholine, dimethylmethacrylamide, N-t-butylacrylamide, diacetonacrylamide, vinylpyrrolidone, glycidyl acrylate or glycidyl methacrylate, or copolymers of the above monomers with other copolymerizable monomers.

Examples of resins are homopolymers of ethylenically unsaturated esters or ethylenically unsaturated acids represented by, for example, acrylic acid esters such as ethyl acrylate or butyl acrylate, methacrylic acid esters such as methyl methacrylate or ethyl methacrylate, acrylic acid or methacrylic acid, or the acid derivatives thereof, or copolymers of these monomers with other vinylic monomers; or copolymers of polycarboxylic acids such as itaconic acid, itaconic anhydride, maleic acid or maleic anhydride with vinylic monomers such as styrene, vinyl chloride, vinylidene chloride or butadiene, or trimers of these monomers with other ethylenically unsaturated monomers.

The above-described resins can be used as an aqueous solution, a solution in an organic solvent or a dispersion as a latex in water.

With respect to the non-volatile or low volatile liquids to be dispersed in the subbing layer, all such liquids can be used so long as they do not dissolve the subbing resin, do not entirely diffuse into the subbing layer or completely disappear through drying.

The remarkable effect of this invention can be attained due to the fact that fine droplets are always present in the subbing layer throughout the coating and during and after the drying, and the effect is not directly influenced by the chemical properties of the droplets. Therefore, in practice, those liquids can be selected depending upon the subbing resin and the solvent for the subbing composition, which can be emulsified and dispersed in the subbing composition without being completely miscible with the composition and, in addition, droplets of which do not disappear when the composition is coated on a support and then dried.

For example, if gelatin, a widely used hydrophilic resin, is employed as a subbing resin and water, most easily handled, is used as a solvent, the following liquids can be selected: esters or amides derived from organic acids or inorganic acids such as phthalic acid, adipic acid, phosphoric acid, citric acid, sebacic acid, isophthalic acid, cyclohexanedicarboxylic acid, benzoic acid, caprylic acid, caproic acid, glycolic acid, pelargonic acid, azelaic acid, tetrahydrophthalic acid, fumaric acid, maleic acid, stearic acid, abietic acid, oleic acid, ricinoleic acid, lauric acid or palmitic acid; esters or ethers derived from polyhydric alcohols such as ethylene glycol, butanediol, diethylene glycol, propylene glycol, pentaerythritol, glycerol or cyclohexanediol; alkylphenols, alkylnaphthalenes, halogenated paraffins, as well as vegetable oils, animal oils, minerial oils, or the like.

Any of the above substances can be used if they are liquid as such or in admixture at, for example, about 25° C. Suitable boiling points of the liquids are above about 120° C, preferably above about 160° C. Moreover, they preferably have a low solubility in water, which can be determined by a simple test by those skilled in the art. A suitable solubility in water for the liquids is a solubility of about 10 g/100 g of water at 25° C or less if liquids are used immediately after dispersion. A preferred solubility is a solubility of about 0.1 g/100 g of water or less. A particularly preferred solubility in water is a solubility of 0.05 g/100 g of water or less from the standpoint of shelf-life and handling.

Specific examples of suitable liquids are diethyl adipate, dibutyl adipate, diisobutyl adipate, di-n-hexyl adipate, dioctyl adipate, dicyclohexyl adipate, di-2-ethylhexyl azelate, dioctyl sebacate, diisooctyl sebacate, dibutyl succinate, octyl stearate, dibenzyl phthalate, tri-o-cresyl phosphate, diphenyl-mono-p-tert-butylphenyl phosphate, monophenyl-di-o-chlorophenyl phosphate, monobutyl-dioctyl phosphate, 2,4-di-n-amylphenol, 2,4-di-tertamylphenol, 4-n-nonylphenol, 2-methyl-4-n-octylphenol, N,N-diethylcaprylamide, N,N-diethylaurylamide, glycerol tripropionate, glycerol tributyrate, glycerol monolactate diacetate, tributyl citrate, acetyltriethyl citrate, di-2-ethylhexyl adipate, dioctyl sebacate, di-isooctyl azelate, diethyleneglycol dibenzoate, dipropyleneglycol dibenzoate, triethyl citrate, tri(2-ethylhexyl) citrate, acetyl-tri-n-butyl citrate, di(isodecyl)-4,5-epoxytetrahydrophthalate, oligovinyl ethyl ether, dibutyl fumarate, polyethylene oxide (degree of polymerization $>>16$), glycerol tributyrate, ethylene glycol dipropionate, di-(2-ethylhexyl) isophthalate, butyl laurate, tri-(2-ethyl-hexyl) phosphate, triphenyl phosphate, tricresyl phosphate, silicone oils, dimethyl phthalate, diethyl phthalate, dipropylene phthalate, dibutyl phthalate, diisooctyl phthalate, diamyl phthalate, di-n-octyl phthalate, diamylnaphthalene, triamylnaphthalene, monocaprin, monolaurin, monomyristin, monopalmitin, monostearin, monoolein, dicaprin, dilaurin, dimyristin, dipalmitin, distearin, diolein, 1-stearo-2-palmitin, 1-palmito-3-stearin, 1-palmito-2-stearin, triacetin, tricaprin, trilaurin, trimyristin, tripalmitin, tristearin, triolein, tripetroselin, trierucin, triricinolein, linoleo-distearin, linoleo-dilinolein, oleo-dierucin, linoleodierucin, palmito-oleo-linolein, paraffin, drying oils such as linseed oil, perila oil, tung oil, hempseed oil, kaya oil, walnut oil, soybean oil, poppy seed oil, sunflower oil, catalpa oil, arrowhead oil or safflower oil; semi-drying oils such as cotton seed oil, corn oil, sesame oil, rapeseed oil, rice bran oil, croton oil, mustard oil, kapok oil or dehydrated castor oil; groundnut oil, olive oil, tsubaki oil, sasanoqua oil, tea seed oil, castor oil, hydrogenated castor oil, almond oil; ben seed oil or chaulmoogra oil.

Such compounds are already well known and are described, for example, in U.S. Pat. Nos. 2,322,027, 2,533,514, 2,588,765, 2,960,404, 3,121,060 and 3,287,134, German Pat. No. 1,152,610, British Pat. Nos. 955,061 and 1,272,561, Japanese Patent Publication No. 21,766/68, Japanese Patent Laid-Open Application No. 14322/73 and Kuwata, *Fats and Oils Chemistry,* Iwanami, 1968, Tokyo.

Of these compounds, esters of adipic acid, phthalic acid, succinic acid, fumaric acid, azelaic acid, isophthalic acid or phosphoric acid and esters of glycerol can be advantageously employed since they do not adversely affect the photographic light-sensitive material and are easily available, chemically stable and hence easily handled.

Of all of the materials, the more hydrophobic liquids have a significant effect on the adhesion when water is, for example, used as a solvent for the subbing layer, possibly because of easy formation of fine droplets of the materials.

In using a subbing resin other than gelatin and a solvent other than water, droplets can be formed by selecting liquids which are not compatible or are barely compatible with each.

The droplets can be formed employing emulsification or dispersion methods generally used in the fields of photographic emulsions, cosmetics, etc.

That is, a non-volatile or low volatile liquid can be dispersed or emulsified in a sufficiently fine state in a subbing resin composition by mixing the resin composition with the liquid and then applying a strong shearing stress, using a mixer, homogenizer, ultrasonic wave, etc., to the mixture.

It is preferred in the formation of droplets to add an emulsifier generally used to improve the efficiency of the emulsification or stabilize the emulsified dispersion produced. As such emulsifiers, anionic surface active agents, nonionic surface active agents, cationic surface active agents or mixtures thereof can be used suitably. From the standpoint of the photographic properties, anionic and nonionic surface active agents are preferred. In addition, regarding the reduction of the particle size of droplets, the anionic surface active agents as described in Japanese Patent Publication No. 9979/73 are particularly preferred. Moreover, bubbles may often be produced during the emulsification. In this case, a defoaming agent can be added, as is described in, for example, Japanese Patent Publication No. 9979/73.

Surface active agents are described in detail, in addition to the above described patent specification, in U.S. Pat. Nos. 2,240,472, 2,271,623, 2,288,226, 2,311,021, 2,322,027, 2,360,289, 2,533,514, 2,739,891, 2,801,170, 2,801,171, 2,852,382, 2,949,360, 3,068,101, 3,158,484, 3,201,253, 3,210,191, 3,294,540, 3,396,027, 3,415,649, 3,441,413, 3,442,654, 3,475,174, 3,545,974, 3,619,195 and 3,775,349, German Patent Laid-Open Application No. 1,942,665, German Pat. Nos. 1,143,707, 2,045,414, 2,043,271 and 2,045,464, and British Pat. Nos. 1,077,317 and 1,198,450. One or more desired agents can be selected from the above surface active agents. The amount of these surface active agents can be optionally varied, but at least an amount sufficient to produce a substantially emulsified product is used.

Referring to the size of droplets to be dispersed, a smaller size provides a better result considering the transparency of the subbing layer. The thickness of the subbing layer is usually less than about 1 micron in most cases since the layer is easily get damaged if the layer is unnecessarily thick. Therefore, when a subbing coating is applied in a separate step and a photographic layer is coated thereon after drying the subbing layer as in a conventional process, the droplets preferably have a diameter less than about 1 micron. However, in forming the photographic material of this invention, gelatin can be used as a subbing resin and, hence, the subbing resin can be cast as a lowermost layer of the photographic layers simultaneously at the time of coating the photographic layers. In this case, a thick subbing layer can be provided since the subbing layer will not be injured if it is thick, with droplets having a diameter even larger than about 1 micron being sufficiently effective with respect to the adhesion. Briefly, the droplets provide a sufficient effect as long as their diameters are smaller than the thickness of the subbing layer. However, in practice, the size of the droplets is desirably less than about 1 micron because as the size of the droplets increases, the stability with time of the liquid per se is decreased and the transparency of the coating film produced is lost. In fact, when the particle size of the droplets is changed with the volume ratio of the droplet-forming liquid to the binder-forming resin being kept constant, the transparency of the coating film is improved and the adhesive strength is increased as the size of the droplets decreases.

The droplets can be formed, as described above, by applying a strong shearing stress to the liquid using a mixer or a homogenizer and with the aid of a surface active agent. In prior art techniques, droplets having an average particle size as low as about 0.01 $\mu$ can easily be prepared and are suitable for this invention.

In general, the objects of this invention can be satisfactorily attained with droplets of an average particle size of about 1 to about 0.01 $\mu$. In general the thickness of the subbing layer or photographic layer containing the liquid droplets is above about 0.1 $\mu$. For decreasing the size of the droplets it is advantageous to previously dissolve a non-volatile liquid together with a volatile liquid to form an emulsion, evaporate only the volatile liquid by drying them after coating and, as the result, obtain droplets of the non-volatile liquid having a small particle size.

In order to prevent a reduction in the limiting viscosity due to the treatment for rendering the surface of the support hydrophilic, and to moderate the treating conditions for enabling a repeated use of the support such as polyester, those compounds can be incorporated, if desired, into a layer containing droplets of this invention, which have one or more groups selected from carboxy, methylol, hydroxy, oxirane, epoxy, glycidyl, ethyleneimino, isocyanate, thioisocyanate, acetal, ketal, vinyl, acryloxy, methacryloxy, carbodiimide, phenolic hydroxyl, thiol, amino, alkylamino, acylamino, carbamoyl, thiocarboxy, thiocarbamoyl, guanidyl, hydrazino, oxime, ureido and thioureido groups. Such compounds are, for example, diepoxy compounds, polyisocyanate compounds, etc.

Moreover, resins, emulsion polymerization products, etc., can be incorporated into the layer. With respect to latices, for example, reference can be made to U.S. Pat. Nos. 3,142,568, 3,193,386, 3,062,674, 3,220,844, 3,287,289, 3,411,911, 3,411,912 and 3,488,708, etc. and those skilled in the art can easily select appropriate ones depending upon the purposes, uses and conditions in use of the material formed according to the process of this invention.

The droplets used in this invention can be an emulsion prepared by simultaneously mixing one or more oils, or they can be prepared by mixing or re-dispersing separate emulsions. That is, an emulsion can be used with no difficulties whether it is a mono-dispersed emulsion or multi-dispersed emulsion, or whether its particle size distribution is broad or narrow.

Referring to the amounts of the resin used for the subbing layer and the liquid dispersed therein, the adhesive strength increases as the amount of the liquid increases in any combination of the resin and the liquid as long as the amount of the liquid remains relatively less than that of the resin. However, if the amount of the liquid is increased too much, the adhesive strength again decreases because of a reduction in strength of the subbing layer due to a decrease in the cohesion of the layer itself or because the droplets can no longer be held in the resin after the drying and thus are forced out of the resin. Accordingly, the amount of the liquid which can be added is dependent upon the film-forming property of the resin per se and the strength of the film, but the droplets can be present usually in an amount up to about three times by volume to the volume of the resin. Particularly preferred amounts of the droplets range approximately over 1/5 to 2 times by volume to the volume of the resin on a dry basis from the standpoint of the adhesion, film strength, transparency, adaptability for double-layer coating, etc.

By coating the resin composition with a non-volatile or low volatile liquid dispersed therein on the support and then drying as described above, only the solvent is evaporated to form finally on the support a resin film in which only the non-volatile or low volatile liquid is dispersed as fine droplets.

The coating film thus obtained has extremely excellent adhesion to the support as compared with a film of the same resin which does not have a non-volatile or low volatile liquid dispersed therein.

This improvement in adhesion is attributed, it is supposed, to the fact that the residual stress caused by the shrinkage of the coating film which is produced in the course of drying the coating film is probably released and reduced remarkably due to the fine droplets. This assumption is supported also by the fact that the adhesion of the coating film is improved with respect to all subbing resins and all liquids dispersed. Therefore, it is conceivable that the photographic material of this invention also has the advantage that curling caused by the subbing coating as in conventional processes is not produced, since no shrinkage stresses are experienced during the drying of the coating film.

Of the photographic materials of this invention, those containing gelatin as a subbing layer are most industrially advantageous, because a basic ingredient of the resin used for the photographic layer provided on the subbing layer is composed, in most cases, of a hydrophilic resin, particularly gelatin and, therefore, the affinity between the photographic layer and the subbing layer is extremely high. In addition the subbing layer can be coated simultaneously with the coating of the photographic layer due to the property of gelatin of gelling (setting) at lower temperatures, that is, because simultaneous casting is possible. By using this method, a specific coating apparatus for the subbing layer is not necessary and, in addition, the number of steps is reduced by one, so difficulties caused by failures which may occur in this step can be avoided.

This invention has a significant advantage in that a gelatin layer can be tightly adhered directly on a hydrophobic support, which can not be achieved heretofore, by providing a subbing layer with the constitution according to this invention.

A feature of this invention is that fine droplets are present in a subbing layer by which the adhesive strength is improved. Therefore, it will be of course apparent that the subbing layer can also contain other ingredients than those essential for the adhesion, for example, antistatic agents, dyes, coating aids, matting agents, crosslinking agents, etc. without departing from the scope of this invention.

Each layer of the subbing composition according to this invention and photographic light-sensitive materials can be coated by various coating methods including dip coating, air-knife coating, curtain coating or extrusion coating using a hopper as disclosed in U.S. Pat. No. 2,681,294.

If desired, two or more layers can be coated simultaneously using the methods as described in U.S. Pat. Nos. 2,761,791, 3,508,947, 2,941,898 and 3,526,528, as well as in Harasaki et al *Coating Technology,* p. 253, Asakura, 1973, Tokyo.

Film Adhesion Test

A photographic layer to be tested was notched with six traverse lines and six longitudinal lines separated from each other by 5 mm to produce 25 squares. An adhesive tape (Scotch Brand, Mending Tape, trade name produced by Sumitomo Three M Co., Ltd.) was adhered on the layer and quickly peeled off at an angle of 180° C. The adhesive strength was evaluated from the number of squares of the photographic layer thus peeled off and rated in five grades as follows.

| Grade | Number of Squares Peeled Off |
|---|---|
| A | 0 - 5 |
| B | 6 - 10 |
| C | 11 - 15 |
| D | 16 - 20 |
| E | 21 - 25 |

An adhesive strength which is sufficient for practical use as a photographic material is an adhesive strength corresponding to Grade B or Grade A, preferably Grade A, of the above five grades.

All of the adhesion tests described below were determined using this procedure.

This invention is explained in further detail by reference to the following examples. Unless otherwise indicated, all parts, percents, ratios and the like are by weight.

EXAMPLE 1

To 200 g of a 10 wt% aqueous solution of gelatin kept to 50° C, 15 g of a 5 wt% aqueous solution of sodium dodecylbenzenesulfonate (emulsifier) and a predetermined amount of dioctyl adipate (non-volatile liquid) shown in Table 1 were added. The mixture was stirred for 20 minutes using a mixer to prepare a subbing composition. The average diameter of the liquid droplets obtained was about 0.5 $\mu$.

The subbing composition thus prepared was coated so as to provide a film thickness of 2 $\mu$ on a dry basis on a polyethylene terephthalate film of a thickness of 0.1 mm treated with a corona discharge, set at about 5° C for 1 minute and then dried at 25° C for 30 minutes. The corona discharge was performed with a discharge output of 200 W at a 0.8 mm electrode gap while moving a film of a width of 30 cm at a rate of 2 m/min.

An usual silver bromoiodide (containing 2.5 mol% of silver iodide) gelatin emulsion was coated on the film thus subjected to subbing coating at a silver coverage of 3 g per $m^2$ and a gelatin coverage of 3.5 g per $m^2$ of the film. Then, the film was set at 5° C for 1 minute and then dried at 30° C for 30 minutes.

The photographic film thus obtained was subjected to adhesion testing according to the procedure described above. The results obtained are shown together with the amount of the dioctyl adipate in Table 1.

Table 1

| Dioctyl Adipate Amount (g) | Adhesive Strength |
|---|---|
| 0 (control) | E |
| 15 | A |
| 20 | A |
| 25 | A |

The use of dioctyl adipate in an amount on the order of 5 g was less effective.

EXAMPLE 2

The same operation as described in Example 1 was effected using polyethylene terephthalate supports of a thickness of 0.2 mm treated with a glow discharge and flame treatment respectively.

The glow discharge was performed under a reduced pressure of 0.05 mmHg and with an output of 200 W for 5 seconds. The flame treatment was performed by moving a polyethylene terephthalate film of a width of 30 cm at a rate of about 80 m/min which was kept perpendicular to a burner at a distance of 3.5 cm. The composition of the combustion gas used for the flame treatment was a mixed gas of (1) propane gas (0.9 kg/hr) and (2) oxygen gas (2.1 kg/hr), and the area of the burner was about 31 cm $\times$ 0.45 mm. The results obtained are shown in Table 2.

Table 2

| Amount of Dioctyl Adipate (g) | Adhesive Strength | |
|---|---|---|
| | Film Treated with Glow Discharge | Film Treated with Flame Treatment |
| 0 | E | E |
| 15 | A | A |
| 20 | A | A |
| 25 | A | A |

EXAMPLE 3

The same operation as described in Example 1 was effected using a polystyrene support of a thickness of 0.1 mm. The results obtained are shown in Table 3.

Table 3

| Amount of Dioctyl Adipate (g) | Adhesive Strength |
|---|---|
| 0 | E |
| 20 | A |
| 25 | A |

EXAMPLE 4

A solution obtained by heating to 60° C 20 g of di-n-alkyl phthalate having an alkyl group of a different number of carbon atoms as shown in Table 4 and 0.8 g of sorbitan monolaurate (defoaming agent) was poured into 200 ml of an aqueous solution containing 15 g of gelatin and 1.5 g of p-myristic acid amide benzenesulfonic acid sodium salt at an elevated temperature of 60° C. The mixture was stirred for 25 minutes using a high speed agitator (20,000 r.p.m.) to prepare a subbing composition.

The average diameter of the droplets thus obtained was 0.4 microns and the particle size distribution was nearly equal to the normal distribution.

The subbing composition thus obtained was coated on a polyethylene terephthalate film, which was previously treated with a corona discharge under the same conditions as in Example 1, so as to provide a film thickness of 1 μ on a dry basis, set at 5° C for 1 minute and then dried at 25° C for 30 minutes.

On the support thus subjected to subbing coating, a photographic silver halide emulsion for black-white photography of the following composition was coated. The amounts shown in the following are respectively coating amounts per $m^2$ of the film: 3.5 g of silver chlorobromide (containing 3.5 mol% of bromine), 13.0 g of hydroxyethyl methacrylate grafted gelatin (graft rate of 30% by weight), 0.1 g of formaldehyde (37% aqueous solution), 0.03 g of polyethylene oxide (degree of polymerization = 12) and 130 ml of water. The photographic film thus obtained was tested for adhesive strength. The results obtained are shown in Table 4.

Table 4

| Di-n-alkyl Phthalate | Adhesive Strength |
|---|---|
| Di-n-butyl Phthalate | A |
| Di-n-amyl Phthalate | A |
| Di-n-octyl Phthalate | A |
| Di-n-lauryl Phthalate | A |
| None (control) | E |

EXAMPLE 5

To 100 g of an aqueous latex solution containing 20% by weight of polymethylmethacrylate having an average particle size of 0.05 μ, 7 cc of a 5 wt% aqueous solution of sodium dodecylbenzenesulfonate and 10 g of dibutyl phthalate were added. The mixture was stirred for 10 minutes using a mixer to prepare a subbing composition. The average diameter of the liquid droplets obtained was about 0.4 μ.

The subbing composition thus obtained was coated on a polyethylene terephthalate support of a thickness of 0.1 mm, which was previously treated with a corona discharge under the same conditions as in Example 1, so as to provide a film thickness of 2 μ on a dry basis and then dried at 80° C for 20 minutes. On the support thus subjected to subbing coating, the silver halide-gelatin emulsion as in Example 1 was coated at a silver coverage of 3 g per $m^2$ and a gelatin coverage of 3.5 g per $m^2$ of the support, set at 5° C for 1 minute and then dried at 30° C for 30 minutes.

The photographic film thus obtained had an adhesive property of grade A. Using a subbing composition containing no dibutyl phthalate, the photographic film produced had an adhesive property of grade C.

This large difference is caused probably because granular solids such as latex polymer and droplets according to this invention contributed to the adhesion.

EXAMPLE 6

To 200 g of a 10 wt% aqueous solution of gelatin kept to 50° C, 20 g of a 5 wt% aqueous solution of sodium dodecylbenzenesulfonate and 25 g of dibutyl phthalate were added. The mixture was stirred for 20 minutes using a mixer, and then 10 g of potassium poly- p-styrene sulfonic acid potassium salt was further added as a thickner, thus preparing a subbing composition. The average diameter of the liquid droplets obtained was about 0.4 μ.

The thus obtained subbing composition as a first layer and the photographic emulsion as in Example 4 as a second layer were simultaneously coated by a slide coating method on a polyethylene terephthalate support of a thickness of 0.1 mm treated with a corona discharge, set at 5° C for 2 minutes and then dried at 30° C for 30 minutes. The film thickness was 2 μ for the subbing layer and 5 μ for the photographic layer on a dry basis.

The adhesive property of the film thus obtained was tested and found to be grade A. The film was exposed and then developed to obtain an excellent image.

While the invention has been described in detail and with reference to specific embodiments thereof, it will be apparent to one skilled in the art that various changes and modifications can be made therein without departing from the spirit and scope thereof.

What is claimed is:

1. A photographic material comprising a hydrophobic support having a subbing layer comprised of a hydrophilic resin adjacent thereto and at least one hydrophilic photographic layer on said subbing layer wherein said subbing layer contains droplets of a non volatile or low volatile hydrophobic liquid having a boiling point above 120° C, a solubility in water of about 10g/100g water, at 25° C, or less and not completely miscible with the subbing layer, said droplets having a diameter of between about 0.01 and 1 micron and less than the thickness of said subbing layer and being present in an amount of from 1/5 to 3 times by volume to the volume of the subbing layer resin on a dry basis.

2. The photographic material as claimed in claim 1 wherein said support comprises cellulose derivatives styrene polymers, a polyester or a polyolefin.

3. The photographic material as claimed in claim 1 wherein the subbing layer contains a resin having a good affinity for the resin of the photographic layer coated on said subbing layer.

4. The photographic material as claimed in claim 1 wherein the subbing layer contains at least one resin which is the same as the resin of the photographic layer coated on said subbing layer.

5. The photographic material as claimed in claim 1 wherein the subbing layer contains at least one of gelatin, a gelatin derivative or a compound having a carboxy group, a carbonyl group, a hydroxy group, sulfo an amino group, an amino group, or an epoxy group in the molecule or having an acid anhydride skeleton.

6. The photographic material as claimed in claim 1 wherein said non-volatile or low volatile liquid droplet comprise a liquid which is liquid at about 25° C and ha a boiling point above about 120° C or a mixture of liquids which is liquid at about 25° C and has a boiling point above about 120° C.

7. The photographic material as claimed in claim 6 wherein said non-volatile or low-volatile liquid or liquids are esters or amides of organic or inorganic acids esters or ethers of polyhydric alcohols, alkylphenols alkylnaphthalenes, halogenated paraffins, vegetable oils, animal oils or mineral oils.

8. The photographic material as claimed in claim 7, wherein said liquid is an adipate, an azelate, a citrate, a fumarate, an isophthalate, a phthalate, a phosphate, succinate or an ester of glycerol.

9. A method of preparing a photographic material which comprises coating on a hydrophobic support a layer of subbing composition comprised of a hydrophilic resin adjacent thereto containing droplets of non-volatile or low volatile hydrophobic liquid having a boiling point above 120° C, a solubility in water of about 10g/100g water at 25° C, or less and not completely miscible with the remainder of said subbing composition, said deoplets having a diameter between about 0.01 $\mu$ to 1 $\mu$ and less than the thickness of said subbing layer and being present in an amount of from 1/5 to 3 times by volume to the volume of the subbing layer resin on a dry basis, and on said subbing layer at least one hydrophilic photographic layer and drying the resulting material, wherein said droplets are present after said photographic material has been dried.

10. The method of preparing a photographic material as claimed in claim 9, wherein said subbing layer and said hydrophilic photographic layer are coated simultaneously.

11. A photographic material comprising a hydrophobic support having a subbing layer comprised of a hydrophilic resin adjacent thereto and at least one hydrophilic photographic layer on said subbing layer, wherein said subbing layer contains droplets consisting essentially of a non-volatile or low volatile hydrophobic liquid having a boiling point above 120° C, a solubility in water of about 10g/100g water, at 25° C, or less and not completely miscible with the subbing layer, said droplets having a diameter of between about 0.01 and 1 micron and less than the thickness of said subbing layer and being present in an amount of from 1/5 to 3 times by volume to the volume of the subbing layer resin on a dry basis.

* * * * *